United States Patent [19]

Sloupensky et al.

[11] Patent Number: 4,989,402

[45] Date of Patent: Feb. 5, 1991

[54] METHOD OF, AND DEVICE FOR, A SECURED CONTROL OF SPINNING UNITS OF A SPINNING MACHINE, ESPECIALLY OF AN OPEN-END SPINNING MACHINE

[75] Inventors: Jirí Sloupensky; Pavel Seidl; Lubomír Fait; Miroslav Boucek, all of Ûstí nad Orlicí , Czechoslovakia

[73] Assignee: Elitex koncern texilniho strojirenstvi, Liberec, Czechoslovakia

[21] Appl. No.: 254,327

[22] Filed: Oct. 5, 1988

[30] Foreign Application Priority Data

Oct. 5, 1987 [CS] Czechoslovakia ..... 7149-87

[51] Int. Cl.[5] ..... D01H 13/24; D01H 13/32

[52] U.S. Cl. ..... 57/264; 57/81

[58] Field of Search ..... 57/81, 264, 265, 78

[56] References Cited

U.S. PATENT DOCUMENTS 4,020,622 5/1977 Lattion ..... 57/264 X
4,094,133 6/1978 Furrer ..... 57/264
4,292,800 10/1981 Werst ..... 57/264
4,408,447 10/1983 Sloupensky et al. ..... 57/264 X
4,538,408 9/1985 Baltsch et al. ..... 57/264 X
4,569,192 2/1986 Yamada et al. ..... 57/264 X

*Primary Examiner*—Donald Watkins
*Attorney, Agent, or Firm*—Klein & Vibber

[57] ABSTRACT

The invention relates to textile machine control. The run of spinning units is controlled by two busses, a two-way bus, and a reserve one-way bus, the latter being activated, as a rule, by a central electronic system, and possibly, though less often, by the operator. A suitable arrangement of the circuits on the criterion of whether they belong to the two-way bus or to the one-way one, facilitates troubleshooting and permits shorter repair time on vast systems comprising a plurality of work stations of the textile machine.

The invention can be used on various types of spinning machines where a predetermined length of wound yarn is required.

6 Claims, 2 Drawing Sheets

METHOD OF, AND DEVICE FOR, A SECURED CONTROL OF SPINNING UNITS OF A SPINNING MACHINE, ESPECIALLY OF AN OPEN-END SPINNING MACHINE

FIELD OF THE INVENTION

The invention relates to a method of, and device for, a secured control of spinning units of a spinning machine, especially of an open-end spinning machine. The secured control increases the reliability of the function consisting in measuring the length of the package, and also permits to increase the intervals between the successive cleaning of each spinning station.

BACKGROUND OF THE INVENTION

Devices for measuring the length of yarn spun on each spinning unit are known. When a predetermined length of yarn wound is reached the device sets the spinning unit out of operation by interrupting the sliver supply and, consequently, the spinning process of the spinning unit whose bobbin has been fully wound and is to be replaced by an empty tube. Also known are devices registering the time of an uninterrupted run of each spinning station and cutting off the drive of them after the preselected run interval has elapsed. Then follows the rotor cleaning and afterwards the remeasuring of the preselected run interval, required to keep the quality of produced yarn that depends on the length of the spinning interval. In each of these two cases, the input signal for the electronic control system is represented by a signal indicating that the spinning station in question is running, while the output signal controls, via the electronic control system, an electronic clutch responsible for the supply of the material. In view of the analogy both in function and in use, of these devices, the further description will concern only the version based upon the measuring of the yarn length. The signal indicating the run of a given spinning station arrives from this spinning station at the central electronic system via a two-way bus. The signal controlling the run of the spinning station comes from the central electronic system, passes through the two-way bus, and controls by means of a controlled switch, inserted in the circuit of the electromagnetic clutch, the run of the spinning station in question.

A drawback of such a device consists in the fact that even a temporary failure either of the central system or of the two-way bus can generate a false signal in the circuit of the controlled switches related to the spinning stations and, consequently, yarn ruptures on them resulting in production losses due to the necessity to stop such a spinning station, and also resulting in damage to the yarn quality due to an extra spinning-in spot.

SUMMARY OF THE INVENTION

The purpose of this invention is to do away with this drawback and also to permit the plates of the central electronic system as well as the components of the two-way control bus to be tested and exchanged even during the machine run.

The method according to the invention consists in that the control of the spinning stations by means of the two-way control bus is locked by a command coming from the central control system and that the run of the spinning stations in action is maintained by means of a reserve one-way bus.

The principle of the device for carrying into effect the method according to the invention consists especially in that the reserve one-way bus is connected, via separation diodes, with the electromagnets of the clutches of the spinning stations, and via power switch, with the supply circuit.

In this way is obtained a secured control carried out by means of the reserve one-way bus that can be activated either upon the evaluation of the situation carried out by the central electronic system, or in case of need, by the operator. The first of these methods of activation of the reserve bus increases the reliability of the system and its capacity to resist temporary failures, the second one permits and facilitates the check and repair operations on the part of the qualified machine operator.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
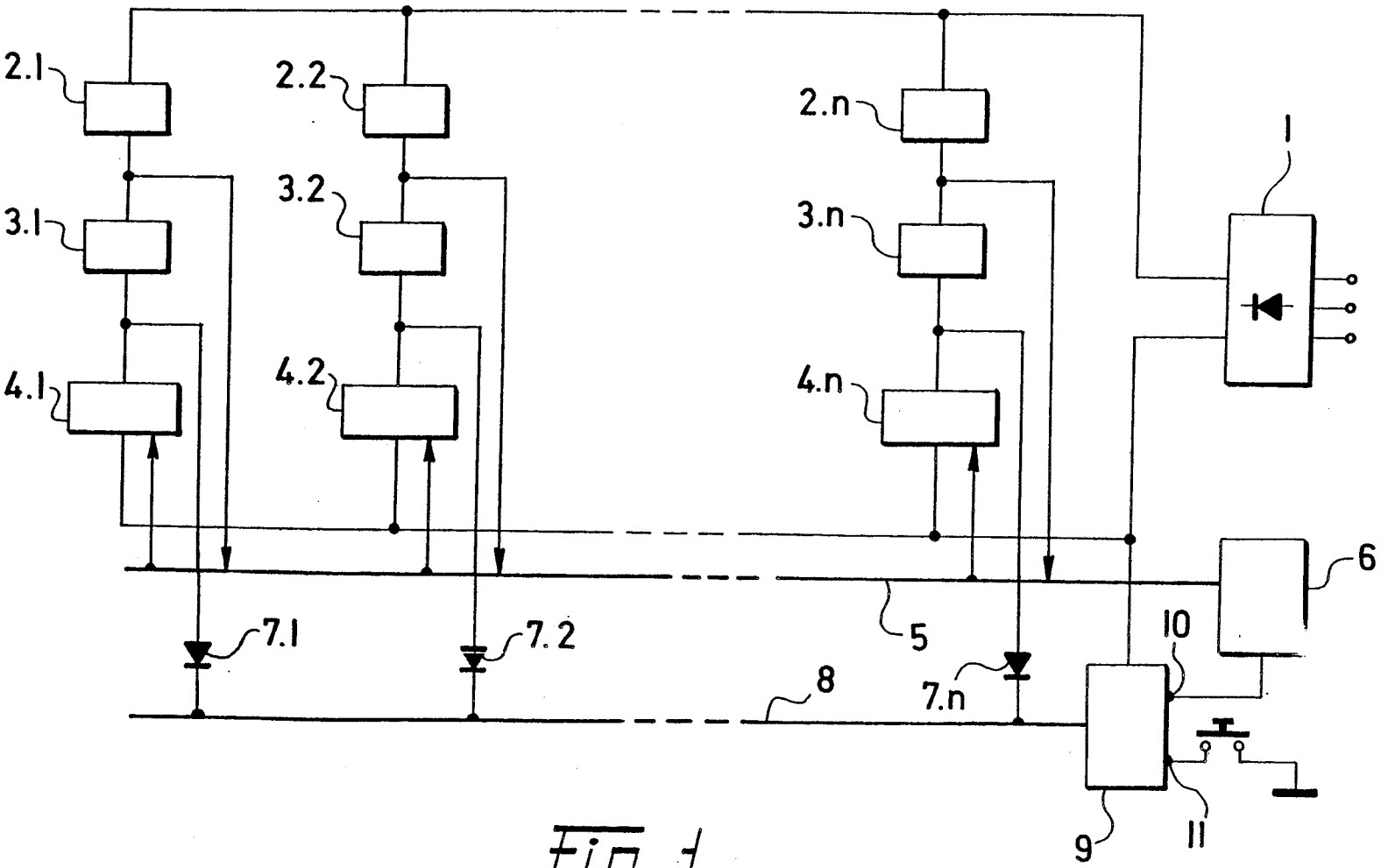
FIG. 1 a block diagram of the device according to the invention.

Referring now to FIG. 1, the spinning machine is equipped with a plurality of spinning stations, each of which contains an electromagnet 3 (3.1, 3.2, . . . , 3.n) made as part of a clutch controlling the supply of the material. Due to this plurality, all the components hereinafter described and related to the spinning stations are marked with indexed numbers, e.g., the electromagnets 3.1 to 3.n. A power source 1 is connected with the electromagnets 3.1 to 3.n by means of controlled switches 4.1 to 4.n. A two-way bus 5 is connected with the controlled switches 4.1 to 4.n, and also with the output of yarn rupture detecting elements 2.1 to 2.n. A reserve one-way bus 8 serves to connect the electromagnets 3.1 to 3.n, via separation diodes 7.1 to 7.n and via power switch 9, with the power source 1.

A central control unit 6 is connected with the two-way bus 5 and with the power switch 9 by means of an input for automatic control 10, the power switch 9 having also a manual operation input 11.

Figure 2:
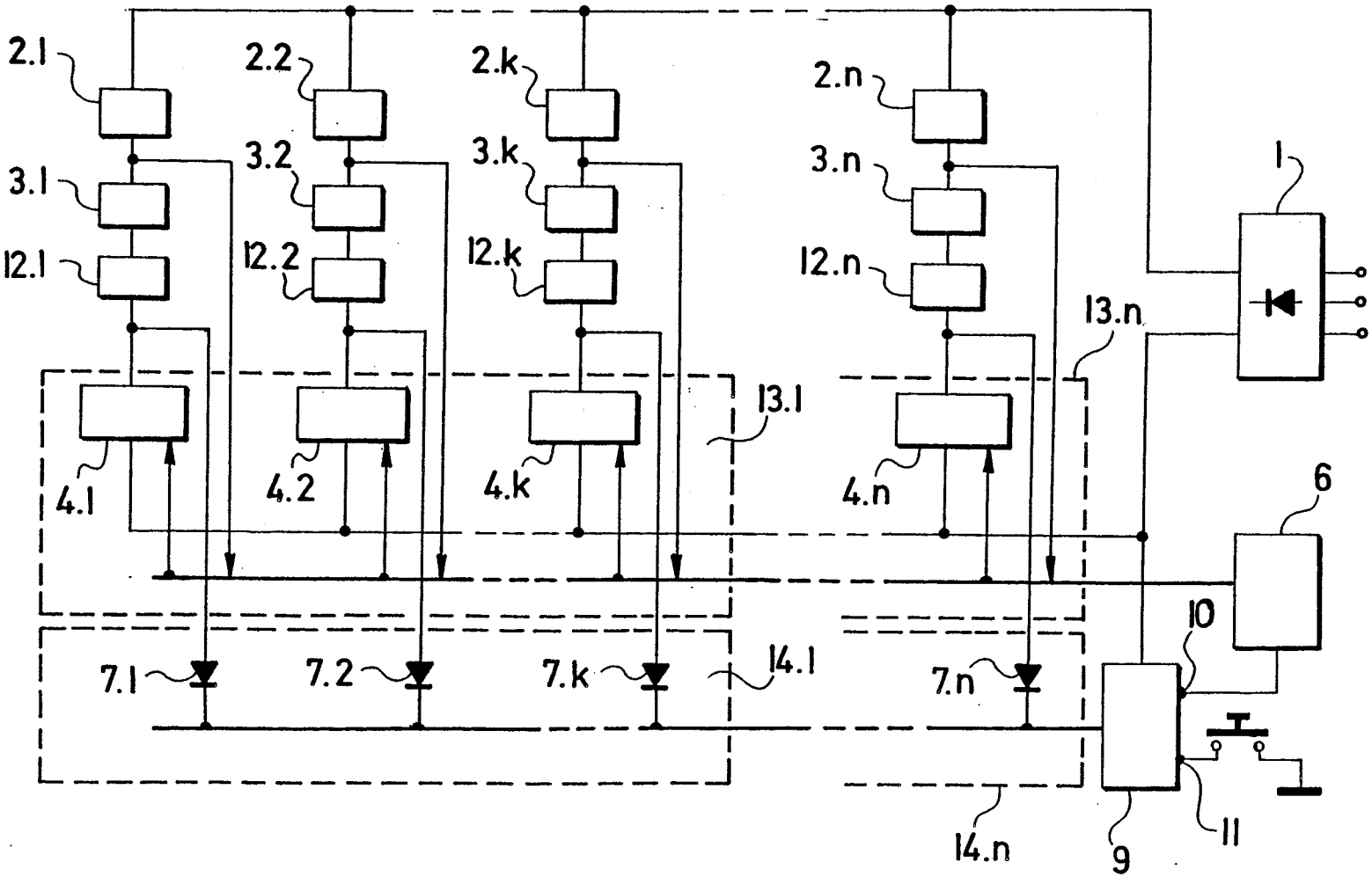
FIG. 2 a block diagram of an embodiment of the device according to the invention, showing also its subdivision into assembly components.

FIG. 2 shows a possible version of the device according to the invention. Between the elecltromagnetic clutches 3.1 to 3.n and the controlled switches 4.1 to 4.n are inserted the yarn rupture detecting elements 21.1 to 12.n, in the section of the spinning station between the draw-off and the winding (not shown). The groups of controlled switches 4 and the corresponding sections of the two-way bus 5 are integrated to assembly units 13.1 tp 13.n. Independently of these assembly units 13.1 to 13.n, assembly units 14.1 to 14.n are composed of the groups of the separation diodes 7 and the corresponding sections of the reserve one-way bus 8.

MANNER OF OPERATION

In order to explain a function of the device according to the invention, a state shall be supposed in which none of the spinning units has reached the predetermined yarn length. This state is registered and evaluated by the central control 6 unit which, by means of the automatic control input 10, keeps the power switch 9 in switched-on state. The current through electromagnets 3 passes to the source 1 via the separation diodes 7.1 to 7.n and via the reserve one-way bus 8 thus by-passing the controlled switches 4.

The operating spinning units have their yarn rupture detecting elements 2 in switched-on state, and the outputs of these detecting elements 2 supply information, via the two-way bus 5, about the running state of the spinning units, into the central control unit 6. As soon as any of the spinning units reaches the predetermined yarn length, this state is evaluated as such by the central control unit 6. Following this, the power switch 9 is switched off by means of the automatic control input 10, and the corresponding controlled switch 4, by means of the two-way bus 5.

After an interval during which the fibres accumulated in the mechanisms of the spinning unit are spun, the integrity of the yarn being spun is interrupted and consequently, the respective yarn rupture detecting member 2 opens. This state, as well, is evaluated by the central control unit 6 and the power switch 9 is switched on and remains so until another spinning unit reaches the predetermined yarn length.

An advantage of the described method and device consists in the fact that the complicated circuits of the two-way bus 5 and the controlled switches 4 related to them, during the period when they are not used to control the run of the spinning units, are locked and replaced by a simple reserve bus 8 featuring inceased reliability and trouble resistance.

The version shown in FIG. 2 contains the assembly units 13 and 14. The units comprise the controlled switches 4 and of the related section of the two-way bus 5. The units 14 comprise the separation diodes 7 and the related section of the one-way bus 8. For the sake of completeness of the basic circuit of the electromagnets 3.1 to 3.n is shown, in series connection with them, the yarn rupture detecting element 12.1 to 12.n, in the section between the draw-off and the winding. In this way are represented the three basic means used for interrupting the spinning process, viz,. the yarn rupture detecting element 2.1 to 2.n, further the yarn rupture detecting element 12.1 to 12.n in the section between the draw-off and the winding, and finally the controlled switch 4.1 to 4.n.

From the point of view of the time required for repairs, primarily important are the sections influencing the run of the whole machine, i.e., the two-way bus 5 and the controlled switches 4, not the sections of the yarn rupture detecting elements and of the electromagnets 3.1 to 3.n.

In the embodiment shown in FIG. 2, the activation of the manual control input 11 will provide for the switched-on state of the power switch 9 for the time required to carry out the repairs. In this state, a defective assembly unit 13 can be exchanged or tested without impairing the machine run.

From the point of view of production and maintenance, it is advantageous to take a division between the assembly units 13 and 14 identically with the division of the spinning units into the machine sections.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. A method for controlling spinning units of a spinning machine, especially of an open-end spinning machine with a central control system measuring spun yarn length on each of a plurality of spinning stations whose run is interrupted by means of a controlled switch, comprising the steps of providing a bidirectional bus for activating and deactivating said controlled switches by said central control system and a one-way bus for bypassing said controlled switches;

activating said one-way bus by a command coming from the central control system;

deactivating said bidirectional bus when said one-way bus is activated during periods when said controlled switches are not used;

deactivating said one-way bus and activating said bidirectional bus when controlled stoppage of spinning units is required;

whereby when said spinning units are in normal operation, power is supplied only from said one-way bus and when a stoppage of spinning units is required, power is supplied only from said bidirectional bus.

2. A method as claimed in claim 1, further comprising the steps of activating said one-way bus when no command to interrupt the spinning process has been given to any spinning station and when no spinning station is carrying out such a command.

3. A method as claimed in claim 1, further comprising the steps of activating said one-way bus manually when necessary to perform maintenance or repairs.

4. A device for controlling spinning units of a spinning machine, especially of an open-end spinning machine with a central control system measuring spun yarn length on each of a plurality of spinning stations whose run is interrupted by means of a controlled switch, comprising said spinning units comprising actuating means;

said controlled switches providing power to said actuating means from a two-way bus; and a one-way bus connected on one side through separation diodes with said actuating means bypassing said controlled switches, and on another side via a power switch with a power supply, said one-way bus providing power to said actuating means during normal operation of said spinning units and said bidirectional bus supplying power to said actuating means during controlled stoppage of said spinning units.

5. A device as claimed in claim 4, wherein the power switch controllable by said central control system is manually controllable as well.

6. A device as claimed in claim 4, wherein groups of said plurality of controlled switches and corresponding sections of said two-way bus being integrated into controlled switch assembly units; and groups of said separation diodes and corresponding sections of said one-way bus being integrated into reserve assembly units independent of said controlled switch assembly units.

* * * * *